US005882499A

United States Patent [19]

Bonnardel et al.

[11] Patent Number: 5,882,499

[45] Date of Patent: Mar. 16, 1999

[54] PROCESS FOR REGULATING THE TEMPERATURE OF THE BATH OF AN ELECTROLYTIC POT FOR THE PRODUCTION OF ALUMINIUM

[75] Inventors: Olivier Bonnardel, Saint Martin D'arc; Pierre Homsi, Saint Jean De Maurienne, both of France

[73] Assignee: Aluminium Pechiney, Courbevoie, France

[21] Appl. No.: 933,057

[22] Filed: Sep. 18, 1997

[30] Foreign Application Priority Data

Sep. 25, 1996 [FR] France ..... 96 11962

[51] Int. Cl.[6] ..... C25C 3/06

[52] U.S. Cl. ..... 205/396

[58] Field of Search ..... 205/396

[56] References Cited

U.S. PATENT DOCUMENTS 3,632,488 1/1972 Decker et al. ..... 205/396 X
4,333,803 6/1982 Seger ..... 205/396 X

FOREIGN PATENT DOCUMENTS 0 195 142 9/1986 European Pat. Off. .
2 307 059 11/1976 France .

OTHER PUBLICATIONS

Database WPI, Section Ch, Week 8617, Derwent Publications Ltd., London, GB; Oct. 7, 1985.

*Primary Examiner*—Donald R. Valentine

*Attorney, Agent, or Firm*—Oblon, Spivak, McClelland, Maier & Neustadt, P.C.

[57] ABSTRACT

The process according to the invention solves the problem of the individual thermal regulation of electrolytic pots. It involves acting on the temperature of the pot by means of the setpoint resistance Ro which is modulated so as to correct the temperature both by anticipation and by reversed feedback. On the one hand, correction by anticipation, known as "a priori" correction allows for known, quantified disturbances and allows their effect on the temperature of the pot to be compensated in advance. On the other hand, reversed feedback correction, known as "a posteriori" correction, involves determining, from direct measurement at regular time intervals of the temperature of the electrolytic bath, a mean temperature corrected as a function of periodic operating procedures and allows the variations and deviations from the setpoint temperature to be compensated. The corrections are made by regular adjustment of a positive or negative so-called additional resistance value which is added to the setpoint resistance Ro of the pot. Correction reversed feedback preferably acts in such a way that, if the corrected mean temperature of the bath is lower than the setpoint temperature, this additional resistance is consequently increased, if the corrected mean temperature of the bath is falling, this additional resistance is also consequently increased, if this corrected mean temperature is higher than the set point temperature, this additional resistance is consequently reduced and if this corrected mean temperature is rising, this additional resistance is also consequently reduced.

12 Claims, 7 Drawing Sheets

PROCESS FOR REGULATING THE TEMPERATURE OF THE BATH OF AN ELECTROLYTIC POT FOR THE PRODUCTION OF ALUMINIUM

TECHNICAL FIELD

The invention relates to a process for regulating the temperature of the bath of a pot for producing aluminum by electrolysis of alumina dissolved in an electrolyte based on molten cryolite by the Hall-Heroult process.

STATE OF THE ART

The control of an electrolytic pot for producing aluminium necessitates maintaining its temperature as close as possible to its optimum functioning temperature or equilibrium temperature. In practice, the temperature of the pot is determined by the maximum temperature within the pot, that is the temperature of the electrolytic bath. As the running conditions of a pot have previously been established and therefore the setpoint temperature of the electrolytic bath, permanent adjustment of the energy supplied to the pot relative to the energy consumed or dissipated by it allows the temperature of the bath to be maintained at its setpoint value. The numerous advantages, in particular with regard to production costs, in being able to regulate the temperature of the electrolytic bath as finely as possible should be remembered in this respect. Thus, a rise in the temperature of the electrolyte by about 10° C. reduces the current efficiency by about 2% whereas a fall in the temperature of the electrolyte by about 10° C. can reduce the already low solubility of the alumina in the electrolyte and promote the anode effect, that is the polarisation of anode, with an abrupt rise in the voltage at the terminals of the pot and liberation of significant quantities of fluorinated and fluoro-carbonated products.

In attempting to reduce the fluctuations in the thermal equilibrium and therefore in the chemical equilibrium of the bath, which is intimately linked to it, for example by additions of aluminium fluoride $AlF_3$ intended to adjust the acidity of the bath as well as its liquidus temperature or incipient solidification temperature, optimum functioning conditions are sought, in particular with regard to the equilibrium temperature. Current efficiencies of about 95% can therefore be achieved, or even of 96% in the case of acidic baths containing a marked excess of $AlF_3$ which allows the equilibrium temperature to be lowered to the region of 950° C. or even lower.

A further advantage of very effective thermal regulation is that it helps to maintain a permanent, sufficiently thick, solidified bath ridge on the pot sides and therefore protects them from erosion, oxidation and chemical attack by the liquid bath and aluminium. This protection of the sides by the solidified bath ridge obviously enhances the longevity of a pot lining and, providing this solidified bath ridge is sufficiently thick, it leads to a reduction in the lateral thermal flux and therefore a reduction in the thermal losses which is reflected by a significant reduction in the energy consumption.

In fact, this thermal regulation is very difficult to carry out industrially, even with the latest state of the art.

Firstly, because there are no effective means available for checking, in a sufficiently reliable and frequent manner, the temperature of the fluorinated sodium-containing electrolytic bath in the vicinity of 950° C. In fact, a temperature probe cannot be immersed continuously in the bath owing to its very high chemical corrosiveness. The use of a thermometric shaft of silicon nitride or of titanium diboride placed in a lateral wall of the pot at the level of the bath and containing a temperature probe according to FR 2104781 only enables the temperature of the bath to be measured in the vicinity of the wall and, furthermore, with significant inertia, therefore without the possibility of rapidly detecting slight variations in temperature (2° to 3° C.). Finally, indirect measurement of the bath temperature and, in particular, electric measurement based on the variations in the bath resistance with the temperature, as recommended by SU 1236003, do not allow this temperature to be checked exactly either because the resistivity of the bath varies locally as it is never perfectly homogeneous, but also over time as its composition evolves with the additions of alumina and $AlF_3$.

In the final analysis, the temperature of the electrolytic bath is very often measured manually and periodically by an operator who opens the cap or door of the pot and immerses an insertion pyrometer in the bath. This procedure obviously has numerous drawbacks: release of fluorinated gas into the environment, exposure of the operator to this harmful release, low frequency of measurement (conventionally one measurement every one or two days) which is difficult to carry out and does not therefore allow sufficiently continuous checking of the temperature for precise and reliable regulation satisfying the new requirements for the control of modern electrolytic pots.

However, it is mainly the problem in controlling the thermal equilibrium of the pot on account of its inertia which makes regulation of pot temperature very awkward, particularly as the pot has a large capacity. In fact, errors can take a long time to appear but, when they do appear, they are difficult to contain and to correct. Some disturbances are an integral part of normal operation of the pot. Of these, some recur at regular time intervals (change of anode, for example), others are irregular and of variable size (addition of frozen bath, for example). These disturbances can therefore be anticipated and taken into consideration, but this does not apply to unforeseeable disturbances (anode effect, abrupt variation in temperature due to a functioning anomaly).

In practice, various parameters are acted upon now and then, these parameters having an indirect correcting effect on the temperature and, in particular, the excess of $AlF_3$ relative to the composition of the cryolite, determined by sampling and chemical analysis in a laboratory. This regulation, which involves corrective additions of $AlF_3$, is generally described as thermal in that it allows for the excess of $AlF_3$ and the temperature and ends by acting on the temperature owing to the relationship between the chemistry and thermal behaviour of the electrolyte, but this thermal effect is achieved with a significant delay. This traditional method of regulation does not allow for the differences in reaction time of the thermal behaviour and the chemistry of the bath in the transient state whereas the purpose of regulation is to intervene as soon as the pot tends to leave its equilibrium point. The thermal behaviour of the pot (the temperature of the bath) reacts rapidly to a thermal stress. For example, the pot reacts very rapidly to an increase in power even if the reaction is only fully effective after several hours or tens of hours owing to the thermal inertia of the pot. On the other hand, the chemistry of the bath, in particular the excess of $AlF_3$, evolves only after a significant delay, the effect of an addition of $AlF_3$ not appearing until several tens of hours or several days after the moment of addition.

It should also be remembered that the higher the excess of $AlF_3$, the greater the increase in the electrical resistivity of the bath which is reflected, if the resistance at the terminals of the pot is kept constant, by a reduction in the anode-metal distance (AMD) which may be harmful to the current efficiency. Conversely, a lack of $AlF_3$ leads to a reduction in the resistivity of the bath which is reflected, if the resistance of the tank is kept constant, by a useless increase in the anode-metal distance which is harmful to the energy efficiency.

On a similar principle, EP 0671488A describes a process for thermal regulation whereby the energy dissipated in and by the electrolytic pot in its various forms is theoretically calculated periodically: energy required to reduce the alumina but also energy absorbed by the various additives such as alumina and $AlF_3$ and by the operating procedures (change of anode, for example). This dissipated energy is compared with the energy supplied to the pot for predefined running conditions. The deviations are then corrected by acting on the setpoint resistance which is increased by enlarging the anode-metal distance (AMD) if a deficit of supplied energy is noted, or is lowered by reducing the anode-metal distance if an excess of energy is noted. Now, when considering only the restitution of heat by the re-oxidation of the aluminium corresponding to the current efficiency loss, which is very unstable over time and depends on the state of the pot, or again the fluctuating mass of cover material based on alumina and frozen bath which falls into the pot during the change of anode, it is obvious to a person skilled in the art that the accuracy of such a theoretical calculation can be at best 5%, which corresponds to inaccuracy of several tens of degrees. Such a method is therefore inapplicable to the fine regulation to within a few degrees of the temperature of the bath of an electrolytic pot.

Furthermore, SU 1 183 565 describes a temperature regulating process whereby the temperature of the bath of the pot is measured periodically and the anode-metal distance is modified directly and solely in proportion, on the one hand, to the deviation between the last temperature measured and the setpoint temperature and, on the other hand, to the deviation between the last temperature measured and the previous one. This approach does not allow for the various disturbances involved in normal industrial operation of electrolytic pots such as changes of anode and additions of frozen bath, which disturbances cause temperature variations which may attain several tens of degrees. For example, after the positioning of a fresh anode, the temperature of the bath drops very rapidly and very markedly, particularly in the vicinity of this anode. In this case, the process according to SU 1 183 565 would lead to a pronounced increase in the anode-metal distance which would lead to over-adjustment owing to the thermal inertia of the pot and consequently to abnormal heating of the pot and a thermal imbalance which is harmful, in particular, to the energy consumption and the current efficiency.

Therefore, no known process for the thermal regulation of an electrolytic pot allows a slight thermal imbalance in the bath to be detected directly and therefore to be corrected instantaneously, and subsequent corrections of the temperature carried out indirectly by regulating the quantity of $AlF_3$ are found to be inadequate to avoid thermal and chemical fluctuations.

Problem Posed

With the search for very high levels of performance in modern, large capacity pots, it has become essential to regulate the temperature of the electrolytic bath very accurately and reliably relative to a desired equilibrium temperature or setpoint temperature, in particular for obtaining a current efficiency of at least 95%, or even of 96%, with acidic baths while at the same time improving the energy efficiency of the pots which, as mentioned hereinbefore, are very sensitive to fluctuations in thermal equilibrium and consequently to the stabilisation of the solidified bath ridge on the sides of the pot.

Object of the Invention

The process according to the invention provides a solution to the problem of the individual thermal regulation of electrolytic pots. It involves acting on the temperature of the pot by means of the setpoint resistance Ro which is modulated so as to correct the temperature both by anticipation and by reversed feedback. On the one hand, correction by anticipation known as "a priori" correction allows for known, quantified disturbances and allows their effect on the temperature of the pot to be compensated in advance. On the other hand, reversed feedback correction known as "a posteriori" correction involves determining, from direct measurement at regular time intervals of the temperature of the electrolytic bath, a mean temperature corrected as a function of the periodic operating procedures, and compensating for variations and deviations of this temperature from a setpoint temperature. The corrections are made by the regular adjustment of a positive or negative so-called additional resistance value which is added to the setpoint resistance of the pot so the temperature of the pot tends toward the setpoint value and variations over time are limited.

Figure 1A:
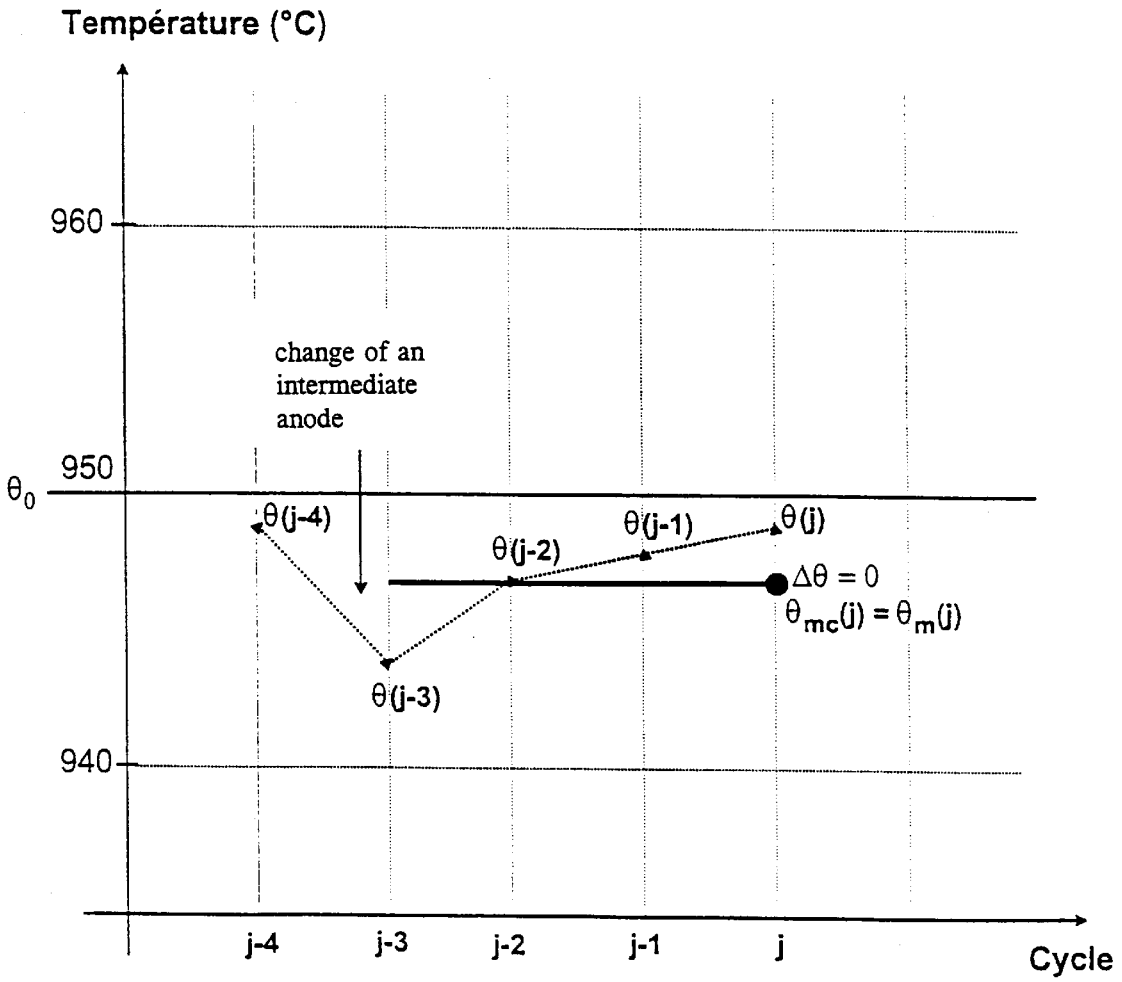
FIGS. 1*a* to 1*c*, illustrate the calculation of the corrected mean temperature.

More specifically, the invention relates to a process for the thermal regulation of a pot for producing aluminium by electrolysis of alumina dissolved in an electrolyte based on molten cryolite by the Hall-Heroult process involving direct measurement at regular time intervals of the bath temperature and involving changes to the anode-metal distance as a function of the measured values of the resistance of the pot R relative to a setpoint resistance Ro, characterised in that, during each thermal regulation cycle of duration Tr corresponding to a working sequence included within the operating cycle of the pot of duration T:

- the temperature θ of the bath is measured at least once;
- the last n measurements are used to determine a corrected mean temperature θmc representative of the mean state of the entire pot and freed of the variations in time and space due to the periodic operating procedures;
- a positive or negative corrective additional resistance RTH is determined, consisting of two terms;
- an a priori correction term RTHa, calculated so as to neutralise by anticipation the disturbances which are irregular but are known and quantified such as the additions of frozen bath,
- an a posteriori correction term RTHb, calculated as a function of the corrected mean temperature θmc and the setpoint temperature θo so as to cause the corrected mean temperature of the pot θmc to tend toward the setpoint value θo and to limit the variations thereof over time;
- the additional resistance RTH is applied to the setpoint resistance Ro of the pot in order to maintain or correct the temperature of the pot.

The term RTHb is advantageously calculated using a regulator, preferably according to an algorithm comprising a proportional, integral and derivative action.

RTHb is generally calculated such that, if the corrected mean temperature of the bath is lower than the setpoint temperature, that is if $\theta mc<\theta o$, this additional resistance is consequently increased, if the corrected mean temperature $\theta mc$ is falling, this additional resistance is also consequently increased, if the corrected mean temperature is higher than the setpoint temperature, that is if $\theta mc>\theta o$, this additional resistance is consequently reduced and if the corrected mean temperature $\theta mc$ is rising, this additional resistance is also consequently reduced.

The values of RTHb are preferably limited to keep them within a permitted range comprising a lower safety threshold (RTHb min) and an upper safety threshold (RTHb max). In practice, the calculated values of RTHb which depart from the permitted range are brought back to the value of the closest threshold. Such a limitation of the permitted values for RTHb allows over-corrections which could result in abnormal temperature values, in particular, to be avoided.

Measurement of the bath temperature is a local measurement in space (at a given location of the pot) and in time (at a given moment in a periodic measurement cycle). Now the temperature of the bath varies according to the adopted location in the pot (at a given moment) and according to the moment of measurement (at a given location). If the effect of the change of an anode, for example, at a given moment is considered, the measured temperature is lower, the closer the changed anode to the point of measurement and, over time, the measured temperature is lower, the more recent the change of anode. Therefore, the temperature measurement cannot be used directly even if taken when the pot is under normal, fixed functioning conditions, that is correctly adjusted, stable and avoiding, by an appropriate wait, the direct impact of the disturbing operating or adjustment procedures such as chance of anode, tapping of metal or specific regulation procedure.

It is therefore necessary to take a mean over time $\theta m$ to eliminate short-term temperature fluctuations, in particular variations due to known periodic disturbances and, in particular, to periodic operating procedures, but it is also necessary to make a spatial correction $\Delta\theta$ to obtain a value representative of the entire pot, that is $\theta mc=\theta m+\Delta\theta$. This experimentally determined spatial correction of temperature can attain 10° C., depending on the procedures considered and the position of the point of measurement.

In practice, the temperature of the bath has to be measured at least once per thermal regulation cycle Tr corresponding to a working sequence. This measurement can be taken intermittently manually but more effectively using a special sensor immersed semi-continuously in the bath and allowing measurements of temperature at much greater frequency, for example every hour.

Allowing for corrections in time and space, the corrected mean temperature is calculated from the bath temperature measurements of the thermal regulation cycles Tr included in the operating cycle of anode change and of tapping of which the duration T is generally 24, 30, 32, 36, 40, 42 or 48 hours, and the corrected mean temperature $\theta mc$ is therefore obtained and used for regulation purposes. In practice, this temperature is recalculated as a sliding average corrected after each new measurement of bath temperature taken at least once per thermal regulation cycle of duration Tr corresponding to a working sequence generally of 4, 6, 8 or 12 hours.

Figure 1B:
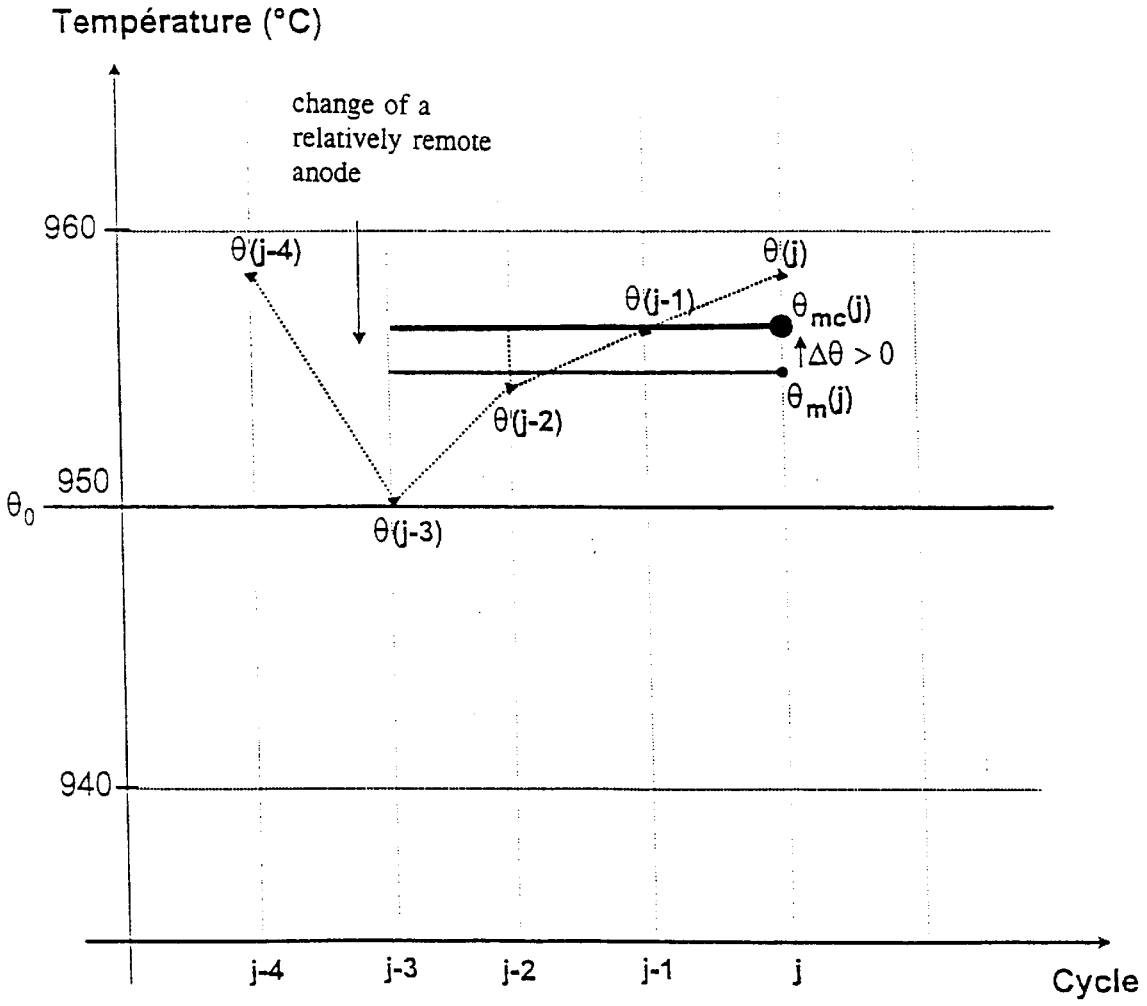
Figure 1C:
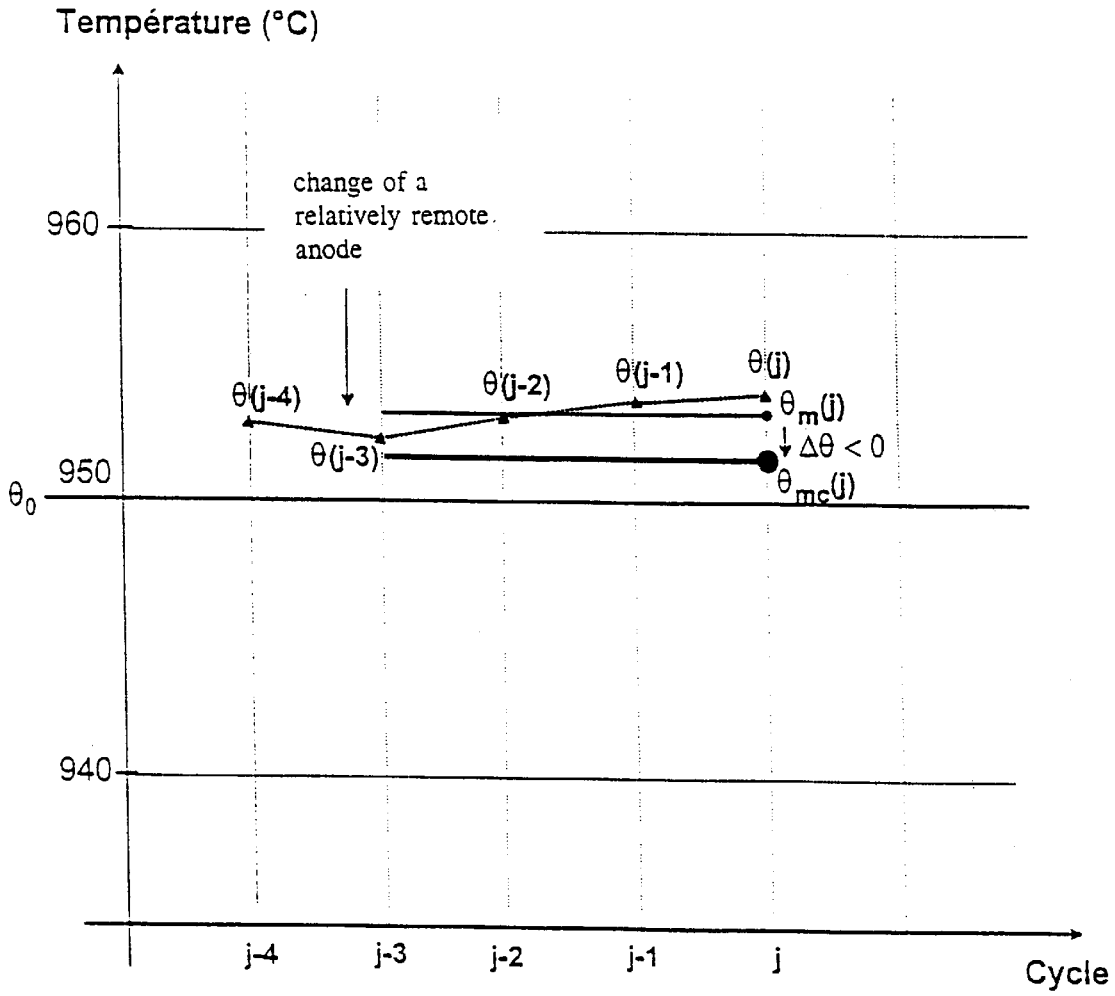

FIGS. 1*a* to 1*c* illustrate the calculation of the corrected mean temperature which is used to determine the term of correction RTHb in shift j in the case where an anode has been changed after measurement of the temperature in shift j-4 and where the mean temperature is calculated by means of the temperature values measured in shifts j-3 to j. FIG. 1*a* corresponds to the case where the changed anode is in a so-called intermediate position relative to the point of measurement so $\Delta\theta$ is zero. FIG. 1*b* corresponds to the case where the changed anode is relatively close to the point of measurement so $\Delta\theta$ is positive. FIG. 1*c* corresponds to the case where the changed anode is relatively far removed from the point of measurement, so $\Delta\theta$ is negative.

It should also be pointed out that the corrected mean temperature $\theta mc$ can be formulated in two ways:

- either in the form of corrected mean temperature $\theta mb$ obtained directly from measurements of bath temperature of which the values are generally between 930° C. and 980° C., this corrected mean temperature $\theta mb$ being compared to the setpoint temperature do of the pot, for example 950° C.,
- or in the form of differential corrected mean temperature $\theta md$ representing the temperature deviation between the previously defined corrected mean temperature $\theta mb$ and the liquidus temperature $\theta 1$ of the bath, bearing in mind that a given liquidus temperature corresponds to a given chemical composition of the electrolytic bath. This temperature deviation between the bath temperature and the liquidus temperature is known by the name of overheat and, in the present case, the differential corrected mean temperature $\theta md$ is none other than the corrected mean overheat. This is compared with the differential setpoint temperature $\theta od$ or again setpoint overheat fixed by the operating parameters of the pot while allowing, in particular, for the lateral thermal flux (proportional to the mean exchange coefficient between the bath and the ridge multiplied by the overheat) linked with the thickness of the lateral solidified bath ridge.

The parameter used for adjusting the additional resistance RTHb is therefore either the corrected mean temperature $\theta mb$ or the differential corrected mean temperature $\theta md$ normally known as corrected mean overheat, or both parameters simultaneously, for example as described in the embodiment of the invention (example e) where the corrected mean temperature $\theta mb$ is selected as basic parameter for adjusting the additional resistance and where the corrected mean overheat $\theta md$ is taken into consideration if it exceeds a fixed threshold.

If the corrected mean overheat $\theta md$ is used as adjustment parameter, the corresponding liquidus temperature $\theta 1$ should be determined at the same time, this liquidus temperature $\theta 1$ traditionally being calculated from the chemical composition of the bath which is therefore determined simultaneously during the working sequence under consideration. The liquidus temperature and the overheat can also be obtained by direct measurement of the electrolytic pot using an appropriate device.

Although the determination of a corrected mean temperature $\theta mc$ (that is $\theta mb$ or $\theta md$) is representative of the mean state of the entire pot and is freed by a corrective term of the variations due to the periodic operating procedures such as changes of anode, it does not allow for impacts on the bath temperature:

- on the one hand irregular but known and quantified disturbances such as additions of frozen bath of which the cooling action is neutralised a priori and in anticipation by an increase in the setpoint resistance Ro of the pot by means of a positive additional resistance RTHa of which the value is calculated as a function of the rate of addition of crushed bath, this increase in setpoint resistance being achieved in practice by a slight increase in the AMD in the pot, on the other hand, unforeseeable disturbances (incidents or functioning anomalies) which should be detected as soon as possible so they can be contained and then corrected rapidly for a return to the setpoint temperature θo or θod if the setpoint overheat is considered, by application of a second positive or negative additional resistance RTHb to the setpoint resistance Ro of the pot.

Therefore, the additional resistance comprises a term RTHa which is allowed for in certain shifts and is intended to compensate by anticipation the irregular but known and quantified disturbances such as additions of frozen bath and a term RTHb which is calculated as a function of the values of θmb and θmd relative to the setpoint values and the evolution thereof.

Therefore, regulation of the pot is carried out on the basis of a setpoint resistance Ro periodically corrected by a value RTH=RTHa+RTHb. Starting from Ro, which may include other terms (for example terms intended to ensure the electrical stability of the pot), regulation generally involves a modification of the anode-metal distance (AMD) such that if the resistance R measured regularly at the terminals of the pot (wherein $R=(U-E)/I_c$, U voltage at the terminals, E electrolysis voltage and $I_c$ intensity of the electrolytic current) is lower than the setpoint resistance, regulation gives an order to raise the anode frame in order to increase the anode-metal distance (AMD) so as to increase the resistance of the bath and approach the setpoint resistance. On the other hand, if the measured resistance is higher than the setpoint resistance, regulation gives an order to lower the anode frame in order to reduce the anode-metal distance (AMD) so as to reduce the resistance of the bath and approach the setpoint resistance.

The process according to the invention will be understood better from the detailed description of its implementation given with reference to FIGS. 1 to 4 corresponding to typical profiles of the evolution in temperature during thermal regulation cycles.

EMBODIMENT OF THE INVENTION

The process according to the invention was carried out over several months on prototypes of electrolytic pot with prebaked anodes supplied at 400,000 amperes. The alumina is introduced directly into the molten electrolysis in successive doses of substantially constant mass through several inlet orifices which are kept open permanently by a crust breaker. The additions of bath in the form of crushed bath or of cryolite and the additions of $AlF_3$ intended to adjust the volume and acidity of the bath respectively are produced in similar manners:

bath composition: cryolite $AlF_3$, 3 NaF+12% excess $AlF_3$ setpoint temperature θo=950° C.

liquidus temperature θ1=938° C.

setpoint overheat θod=12° C.

duration of thermal regulation cycle Tr=1 shift of 8 hours duration of the operating cycle T=32 hours number of temperature measurements per shift=1 corrected mean calculated over the last 4 temperature measurements setpoint resistance Ro=5.930 μΩ permitted range for RTHb fixed at RTHb=−0.100 μΩ and max RTHb=+0.200 μΩ resistance R at the terminals of the pot calculated periodically from the relationship $R\,[ohm]=(U-E)/I_c$, where U is the voltage at the terminals of the pot in volts, $I_c$ the intensity of the electrolytic current in amperes and E the electrolytic voltage of, for example, E=1.65 volts in the present case.

Measurements of bath temperature taken at least once per shift of 8 hours in a stable, adjusted pot outside the disturbing operating or adjustment procedures are taken under very good conditions using the temperature and electrolytic bath level measuring device as described in FR-2727985 (=EP-A-0716165). This device does in fact allow numerous, frequent measurements of bath temperature with the same probe with accuracy of ±2° C. for each unit measurement without manual intervention and therefore with risking the safety and health of the operators.

The term RTHb was calculated by a regulator comprising a proportional, integral and derivative action and including a term for correcting the overheat in certain cases. The proportional corrective term P was calculated with a correcting coefficient fixed at p=−0.0400 μΩ/°C., this correcting coefficient preferably being within the range −0.5000 μΩ/°C.<p<−0.0002 μΩ/°C.; the integral corrective term I was calculated with a correcting coefficient fixed at i=−0.00005 μΩ/°C., this correcting coefficient preferably being within the range −0.10000 μΩ/°C.<i<0.00000 μΩ/°C.; the derivative corrective term D was calculated with a correcting coefficient fixed at d=−0.0200 μΩ/°C., this correcting coefficient preferably being within the range −0.5000 μΩ/°C.<d<0.0000 μΩ/°C. The overheat correcting coefficient s was −0.0150 μΩ/°C. in the cases described, this correcting coefficient s preferably being in the range −0.5000 μΩ/°C.<s<0.0000 μΩ/°C.

In addition to the value of RTHb, the corrective term RTHa was taken into consideration in certain shifts, which terms was equal to +0.058 μΩ in the presented cases (in proportion to the rate of addition of crushed bath by the automatic feeding device).

Figure 2:
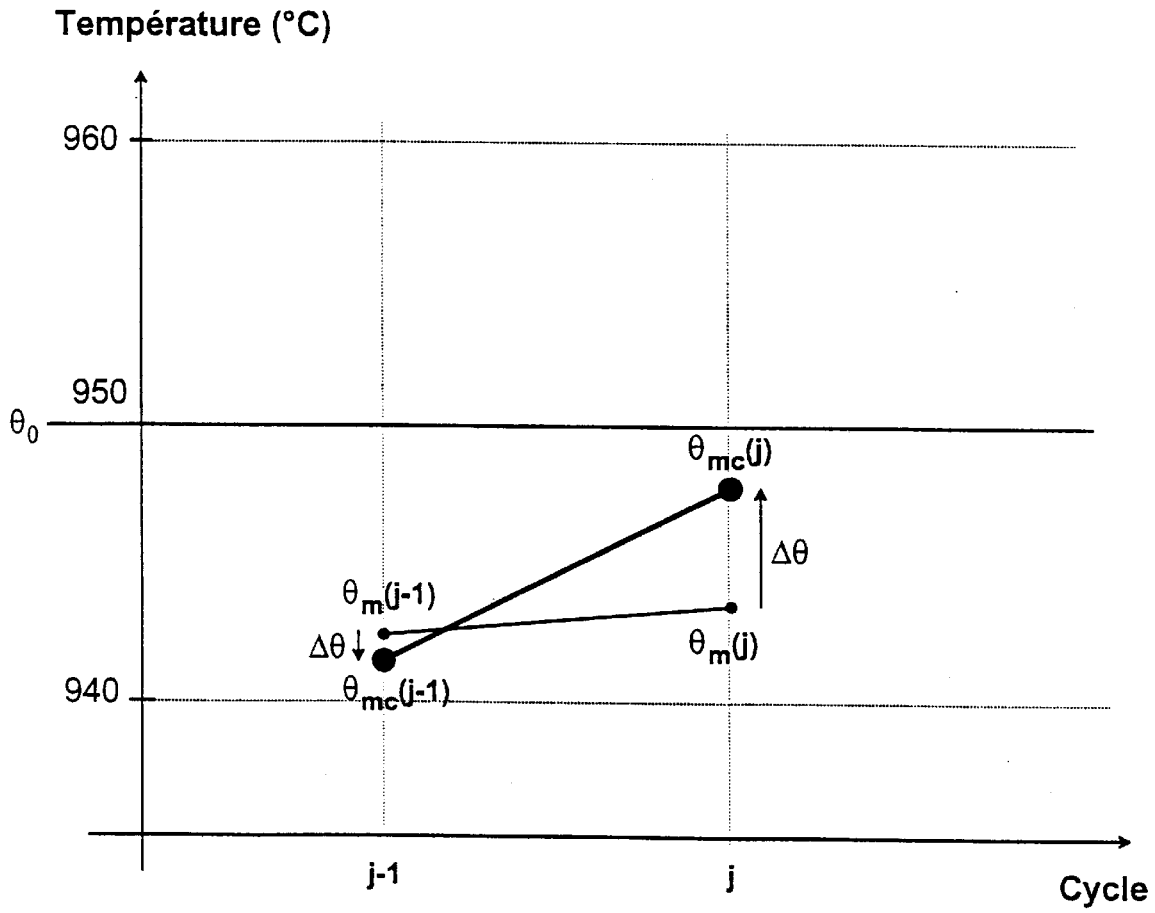
FIGS. 2–5 illustrate the evolution of values between two successive values shown by a fine line for θm and a thick line for θmc.

The following cases a) to e) correspond to different situations observed during the months of implementation of the process according to the invention. These cases correspond to FIGS. 2 to 5 respectively, in which the evolution of the values between two successive values is shown by a fine line for θm and by a thick line for θmc.

a) Case where θmc was rising and where the term RTHb was in the permitted range (according to FIG. 2)

The mean values θm obtained were:

$$\theta m(j)=943.5^\circ\text{ C. and }\theta m(j-1)=942.5^\circ\text{ C.}$$

The anode was changed during shift j-4, before temperature measurement, and during shift j, also before temperature measurement. The correction in temperature Δθ determined by the regulator according to the stored correction tables and applied to the mean temperature was +4.2° C. for shift j, denoting that the anode changed in shift j was very close to the point of temperature measurement and −0.9° C. for shift j-1, denoting that the anode changed in shift j-4 was relatively far removed from the point of temperature measurement. Therefore, the corrected mean temperatures were as follows:

$$\theta mc(j)=\theta mb(j)=943.5+4.2=947.7^\circ\text{ C.}$$

$$\theta mc(j-1)=\theta mb(j-1)=942.5-0.9=941.6^\circ\text{ C.}$$

The corrected mean temperatures actually reveal a pronounced tendency toward a rise in the temperature of the pot which is only partially revealed by the uncorrected mean temperature.

These values were then used to calculate parameters PID for regulating the term RTHb of shift j:

proportional corrective term $P=p\times(\theta mb(j)-\theta o)=-0.0400\times[947.7-950]=+0.092\ \mu\Omega$ integral corrective term $I=I(j-1)-i\times(\theta mb(j)-\theta o)=0.00005-0.00005\times[947.7-950\ ]=0.00017\ \mu\Omega$ to rounded to $0.000\ \mu\Omega$ for calculating RTHb derived corrective term $D=d\times(\theta mb(j)-\theta mb(j-1))=-0.0200\times(947.7-941.6)=-0.122\ \mu\Omega$ therefore $RTHb=0.092+0.000-0.122=-0.030\ \mu\Omega$.

Although the temperature θmb(j) is lower than θo, the rapid rise in the temperature makes the derivative term preponderant and leads to the introduction of a negative additional resistance $RTHb=-0.030\ \mu\Omega$ which remains in the range permitted for RTHb.

The correcting term RTH in shift j was therefore equal to:

$$RTH(j)=RTHa+RTHb=+0.058\ \mu\Omega-0.030\ \mu\Omega=+0.028\ \mu\Omega.$$

Figure 3:
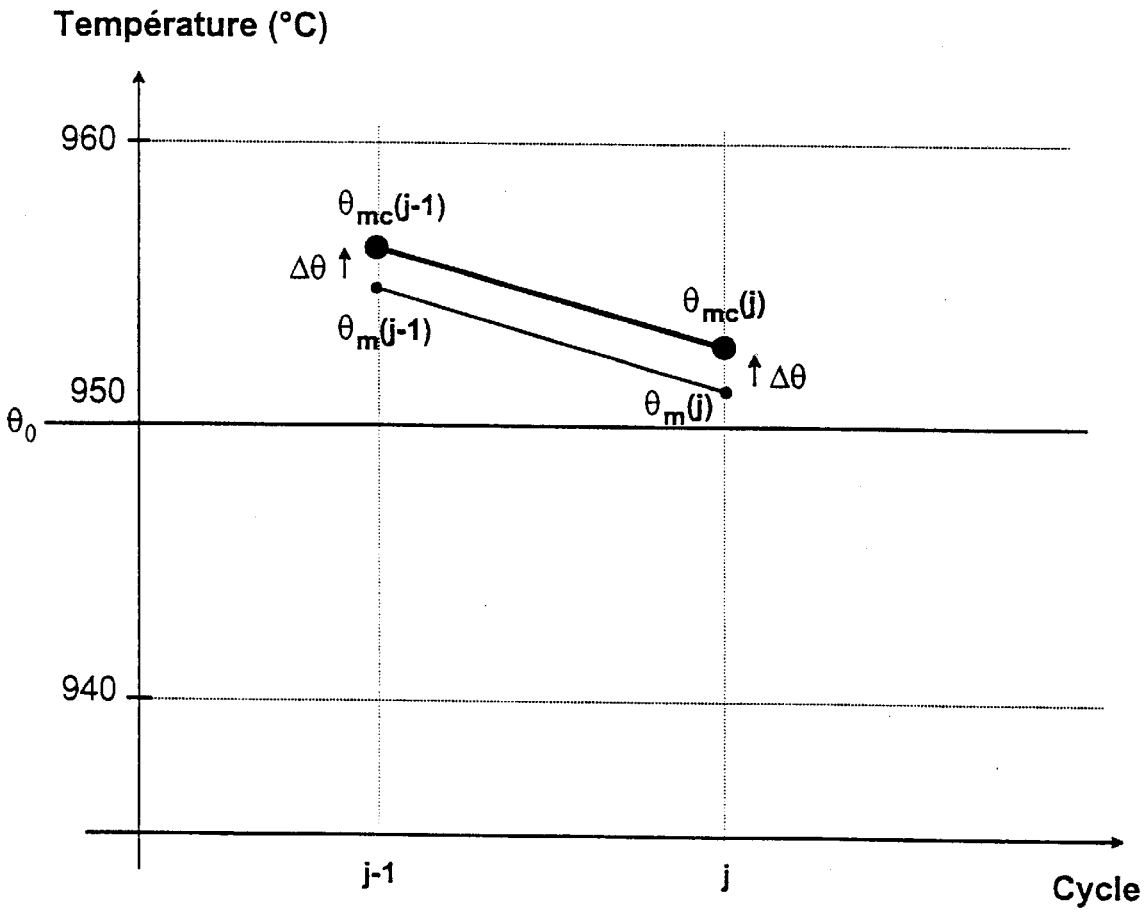

Therefore, despite a fairly pronounced tendency toward a rise in the temperature of the pot, the correction RTH is in fact slightly positive because the a priori correcting term RTHa which counterbalances the a posteriori regulating term RTHb anticipates cooling.

b) Case where θmc was falling and where RTHb was in the permitted range (according to FIG. 3)

The mean values θm obtained were:

$$\theta m(j)=951.3^\circ\ C.\ \text{and}\ \theta m(j-1)=954.9^\circ\ C.$$

In this case, the anode was changed during shift j-3. The temperature correction applied was +1.5° C. for shifts j and j-1, denoting that the changed anode was relatively close to the point of temperature measurement. The corrected mean temperatures were therefore:

$$\theta mc(j)=\theta mb(j)=951.3+1.5=952.8^\circ\ C.$$

$$\theta mc(j-1)=\theta mb(j-1)=954.9+1.5=956.4^\circ\ C.$$

For the regulating parameters PID in shift j, we have:

$$P=-0.0400\times(952.8-950)=-0.112\ \mu\Omega$$

$$I=0.00011-0.00005\times[952.8-950]=-0.00003\ \mu\Omega\ \text{rounded to}\ 0.000\ \mu\Omega$$

$$D=-0.0200\times(952.8-956.4)=+0.072\ \mu\Omega$$

therefore $RTHb=-0.112+0.000+0.072=-0.040\ \mu\Omega$.

The proportional term prevails over the derivative term and leads to introduction of a negative additional resistance $RTHb=-0.040\ \mu\Omega$ which remains in the permitted range and aims to lower the temperature of the pot.

The correcting term RTH in shift j was therefore equal to:

$$RTH(j)=RTHa+RTHb=+0.058\ \mu\Omega-0.040\ \mu\Omega=+0.018\ \mu\Omega.$$

Figure 4:
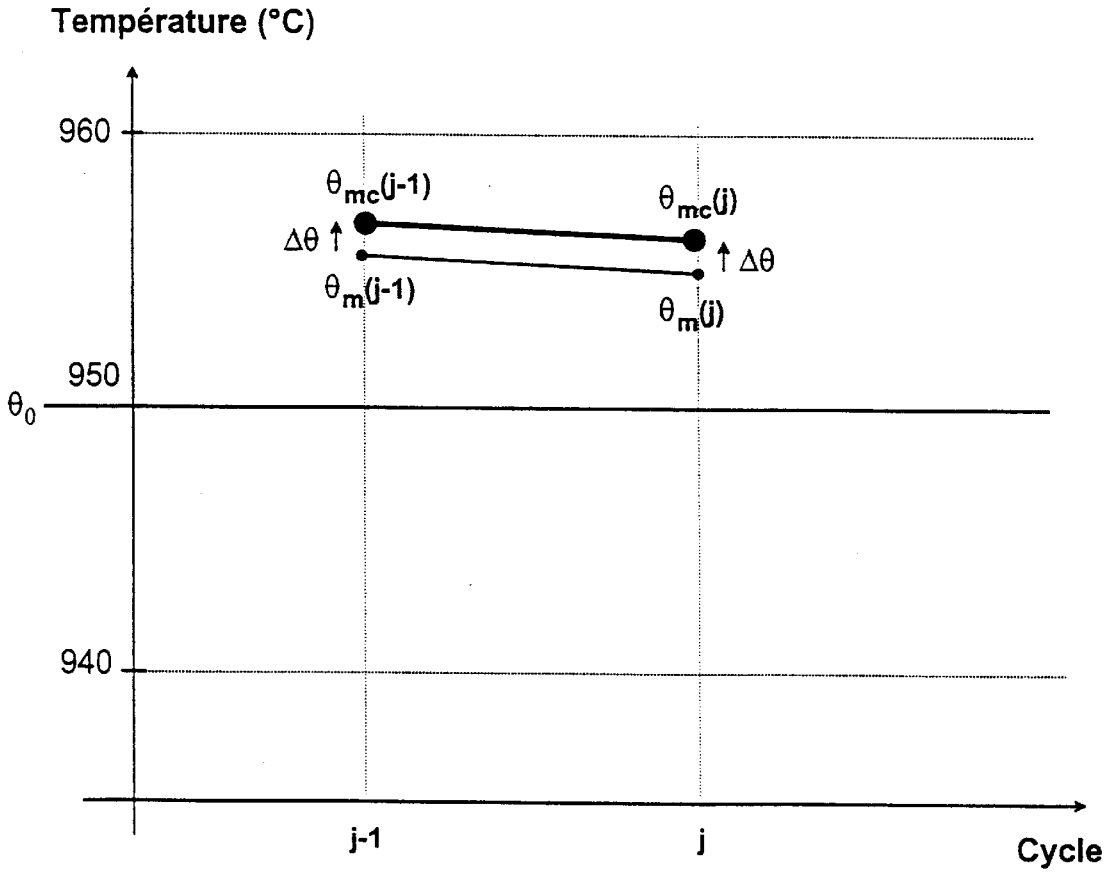

This slightly positive term, which manifests a mutual compensating effect of the a priori and a posteriori correcting terms, leads to a relatively slight correction of the setpoint resistance.

c) Case where θmc was substantially constant, with θmb>θo, and where RTHb departed from the permitted range (according to FIG. 4)

The mean temperature values obtained were:

$$\theta m(j)=955.0^\circ\ C.$$

$$\theta m(j-1)=955.6^\circ\ C.$$

In this case, the anode was changed during shift j-2. The temperature correction applied was +1.2° C. for shifts j and j-1, denoting that the changed anode was relatively close to the point of temperature measurement. The corresponding corrected mean temperature values were:

$$\theta mc(j)=\theta mb(j)=955.0+1.2=956.2^\circ\ C.$$

$$\theta mc(j-1)=\theta mb(j-1)=955.6+1.2=956.8^\circ\ C.$$

It will be noted that the deviation between the corrected mean temperatures θmb(j) and θmb(j-1) is smaller than 1° C., therefore within the accuracy of unit temperature measurement expected of the most efficient devices.

For the regulating parameters PID in shift j, we have:

$$P=-0.0400\times(956.2-950)=-0.248\ \mu\Omega$$

$$I=-0.00008-0.00005\times[956.2-950]=-0.00039\ \mu\Omega\ \text{rounded to}\ 0.000\ \mu\Omega$$

$$D=-0.0200\times(956.2-956.8)=+0.012\ \mu\Omega$$

therefore $RTHb=-0.248+0.000+0.012=-0.236\ \mu\Omega$, which is limited to $-0.100\ \mu\Omega$ because it is below the lower safety threshold.

The correcting term RTH in shift j was therefore equal to:

$$RTH(j)=RTHa+RTHb=+0.058\ \mu\Omega-0.100=-0.042\ \mu\Omega.$$

Figure 5:
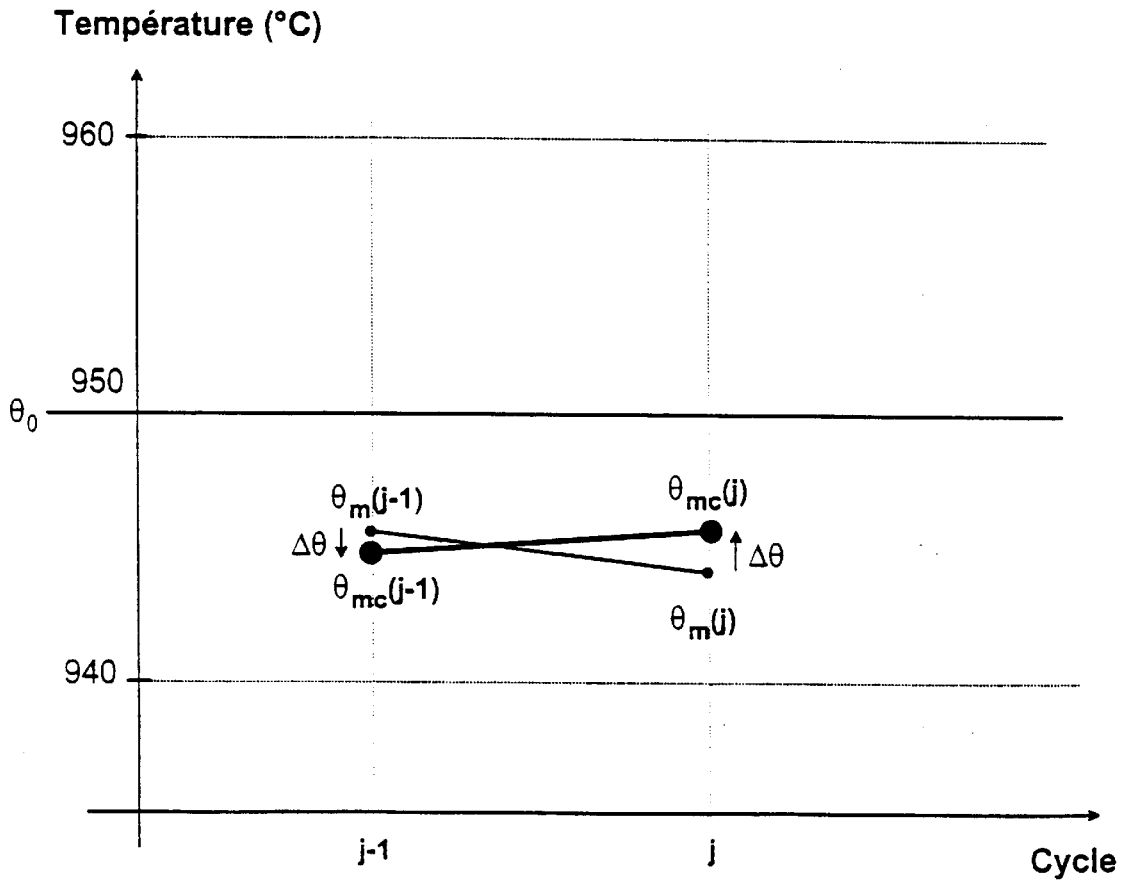

The proportional term therefore becomes preponderant relative to the derivative term and the significantly raised temperature level leads to introduction of a negative additional resistance RTHb, obviously limited to $-0.100\ \mu\Omega$ (lower limit), but significant and which counterbalances the term of correction by anticipation RTHa.

d) Case where θmc was substantially constant, with θmb<θo, and where RTHb was in the permitted range (according to FIG. 5)

The mean temperature values obtained were:

$$\theta m(j)=944.1^\circ\ C.$$

$$\theta m(j-1)=945.7^\circ\ C.$$

The anode was changed during shift j-4 before temperature measurement and during shift j, also before temperature measurement. The temperature correction applied was +1.5° C. for shifts j, denoting that the changed anode was relatively close to the point of temperature measurement and −0.9° C. for shift j-1, denoting that the changed anode was relatively far removed from the point of measurement. The corresponding corrected mean temperature values were:

$$\theta mc(j)=\theta mb(j)=944.1+1.5=945.6^\circ\ C.$$

$$\theta mc(j-1)=\theta mb(j-1)=945.7-0.9=944.8^\circ\ C.$$

Mean temperature correction reveals that the tendency to a rise is in fact the contrary to that revealed by the uncorrected mean temperature, which leads to a change of sign for the term RTHb for the derivative action.

For the regulating parameters PID in shift j, we have:

$$P=-0.040\times(945.6-950)=+0.176\ \mu\Omega$$

$$I=-0.00018-0.00005\times[945.6-950]=+0.00004\ \mu\Omega\ \text{rounded to}\ 0.000\ \mu\Omega$$

$$D=-0.0200\times(945.6-944.8)=-0.016\ \mu\Omega$$

therefore $RTHb=+0.176+0.000-0.016=+0.160\ \mu\Omega$

The proportional term is preponderant relative to the derivative term and the significantly low temperature level leads to introduction of a strong positive additional resistance RTHb=+0.160 μΩ which remains in the permitted range of−0.100 μΩ to +0.200 μΩ.

The correcting term RTH in shift j was therefore equal to:

$$RTH(j)=RTHa+RTHb=+0.058\ \mu\Omega+0.160\ \mu\Omega=+0.218\ \mu\Omega.$$

The combined effect of the a posteriori correcting term and the a priori correcting term allows a significant negative deviation to be largely compensated for, relative to the setpoint combined with a tendency to foreseeable cooling.

e) Case where the calculation of RTHb has allowed for the correction of overheat This allowance for the overheat can be subject to certain conditions, that is in the present case: RTHb value higher than zero and overheat value higher than the setpoint overheat.

The overheat correction can be applied to RTHb in example d).

Therefore, we find RTHb=+0.160 μΩ and an overheat θmd(j)=15.7° C. starting from the liquidus temperature calculated according to the chemical composition of the bath.

Functioning with 12.0% of excess $AlF_3$, a liquidus temperature of 938° C., a setpoint temperature of 950° C. and an overheat of 12° C. is desired.

As the overheat of 15.7° C. exceeded 12° C., an overheat correcting term S of−0.0150×(15.7−12) =−0.056 μΩ, that is corrected RTHb=+0.160−0.056=+0.104 μΩ is obtained.

The correcting term RTH was therefore equal to:

$$RTHa+RTHb=+0.058\ \mu\Omega+0.104\ \mu\Omega=+0.162\ \mu\Omega.$$

It should also be pointed out that the correcting coefficients p, i, d and s as well as their ranges of variation were firstly determined by theoretical calculations using calculating formulae and tools from the Laboratoire de Recherches des Fabrications d'Aluminium Pechiney. They were then refined experimentally on the basis of the results obtained when regulating the temperature of test pots, with the knowledge that parameterisation is better adapted if it allows bath temperatures which are more stable and more closely grouped round the desired setpoint temperature to be obtained. These correcting coefficients p, i, d and s determined in the present case for pots having a current intensity $I_c$=400,000 amperes can easily be transposed to pots having different intensity $I_c'<I_c$ or $I_c'>I_c$, with the knowledge that the preceding values can be defined in relative value with respect to the strength $I_c'$ such that:

$$p'=p\times I_c/I_c'=p\times(4\times10^5\ A)/I_c'$$

$$i'=i\times I_c/I_c'=i\times(4\times10^5\ A)/I_c'$$

$$d'=d\times I_c/I_c'=d\times(4\times10^5\ A)/I_c'$$

$$s'=s\times I_c/I_c'=s\times(4\times10^5\ A)/I_c'$$

Industrial Application

The most characteristic values obtained over several months of running with 400,000 ampere pots operating firstly without regulating the bath temperature (A) then while regulating the temperature according to the invention (B) are compiled in the following table.

| | | A | B |
|---|---|---|---|
| Desired excess $AlF_3$ | % | 11.8 | 13 |
| Total typical deviation | σ% | 1.5 | 0.8 |
| Excess $AlF_3$ at | +/−2σ% | 8.8 to 14.8 | 11.4 to 14.6 |
| Desired temperarure | °C. | 953 | 947 |
| Total typical deviation | σ°C. | 7 | 3 |
| Temperature at | +/−2σ°C. | 939 to 967 | 941 to 953 |
| Current efficiency | % | 94.9 | 96.2 |
| Pot voltage | volts | 4.25 | 4.14 |
| Specific energy | kWh/t (tonne Al) | 13350 | 12830 |

With the process according to the invention, the ranges of temperature adjustment and of $AlF_3$ contents are close to the setpoint values and it is therefore possible to work at lower temperature with a more acidic bath without risking the problems associated with excessively cold running such as poor dissolution of the alumina and sludge formation on the cathodic bottoms since the minimum temperature of the bath remains higher than 940° C. This results in a current efficiency improved by 1.3% and specific energy per tonne of metal reduced by almost 500 kWh/t Al.

We claim:

1. Process for the thermal regulation of a pot for producing aluminium by electrolysis of alumina dissolved in an electrolyte based on molten cryolite by the Hall-Héroult process involving direct measurement at regular time intervals of the bath temperature and involving changes to the anode-metal distance as a function of the measured values of the resistance of the pot R relative to a setpoint resistance Ro characterised in that, during each thermal regulation cycle of duration Tr corresponding to a working sequence included within the operating cycle of the pot of duration T:

the temperature θ of the bath is measured at least once;

the last n measurements are used to determine a corrected mean temperature θmc representative of the mean state of the entire pot and freed of the variations in time and space due to the periodic operating procedures;

a positive or negative additional resistance RTH is determined, consisting of two terms;

an a priori correction term RTHa, calculated so as to neutralise by anticipation the disturbances which are irregular but are known and quantified such as the additions of frozen bath, an a posteriori correction term RTHb, calculated as a function of the corrected mean temperature θmc and the setpoint temperature θo so as to cause the corrected mean temperature of the pot θmc to tend toward the setpoint value θo and to limit the variations thereof over time;

the additional resistance RTH is applied to the setpoint resistance Ro of the pot in order to maintain or correct the temperature of the pot.

2. Process according to claim 1, characterised in that the term RTHb is calculated by a regulator.

3. Process according to claim 1, characterised in that calculation of the term RTHb involves an algorithm by proportional, integral and derivative action.

4. Process according to claim 1, characterised in that the experimentally determined spatial correction of temperature can attain 10° C. depending on the procedures considered and the position of the point of measurement.

5. Process according to claim 1, characterised in that the corrected mean temperature θmc is calculated from the bath temperature measurements of the thermal regulation cycles Tr included in the operating cycle of anode change and of tapping of which the duration T is conventionally 24, 30, 32, 36, 40, 42 or 48 hours.

6. Process according to claim 1, characterised in that the thermal regulation cycle corresponds to a working sequence of which the duration Tr is conventionally 4, 6, 8 or 12 hours.

7. Process according to claim 1, characterised in that the corrected mean temperature θmc is expressed in the form of a temperature θmb deduced directly from the bath temperature measurements and compared to the setpoint temperature θo.

8. Process according to claim 7, characterised in that the corrected mean temperature θmb or corrected mean overheat θmd or a combination of these two values is used as a parameter for adjusting the additional resistance RTHb.

9. Process according to claim 1, wherein the corrected mean temperature θmc is expressed in the form of a differential temperature θmd corresponding to the deviation between a temperature θmb deduced directly from the bath temperature measurements and the liquidus temperature θ1 of the bath, also known as corrected mean overheat, which is compared to the differential setpoint differential temperature or setpoint overheat θod.

10. Process according to claim 9, characterised in that the liquidus temperature θ1 of the bath is calculated from the chemical composition of the bath.

11. Process according to claim 9, characterised in that the liquidus temperature of the bath and the overheat are obtained by direct measurement of the electrolytic pot using an appropriate device.

12. Process according to claim 9, characterized in that the corrected mean temperature θmb or corrected mean overheat θmd or a combination of these two values is used as a parameter for adjusting the additional resistance RTHb.

* * * * *

UNITED STATES PATENT AND TRADEMARK OFFICE

CERTIFICATE OF CORRECTION

PATENT NO. : 5,882,499

DATED : March 16, 1999

INVENTOR(S): Olivier Bonnardel, et al.

It is certified that an error appears in the above-identified patent and that said Letters Patent is hereby corrected as shown below:

Column 6, Line 18, "do" should read --$\theta o$--.

Column 8, Line 23, "$\mu\Omega/°C. < p < -0.0002\ \mu\Omega/°C.$;" should read --$\mu\Omega/°C. \leq p \leq -0.0002\ \mu\Omega/°C.$;--.

Column 8, Line 26, "$-0.10000\ \mu\Omega/°C. < i < 0.00000\ \mu\Omega/°C.$;" should read -- $-0.10000\ \mu\Omega/°C. \leq i \leq 0.00000\ \mu\Omega/°C.$;--.

Column 8, Lines 29 and 30, "$-0.5000\ \mu\Omega/°C. < d < 0.0000\ \mu\Omega/°C.$" should read -- $-0.5000\ \mu\Omega/°C. \leq d \leq 0.0000\ \mu\Omega/°C.$--.

Column 8, Line 33, "$-0.5000\ \mu\Omega/°C. < s < 0.0000\ \mu\Omega/°C.$" should read -- $-0.5000\ \mu\Omega/°C. \leq s \leq 0.0000\ \mu\Omega/°C.$--.

Signed and Sealed this

Twenty-first Day of September, 1999

*Attest:*

Q. TODD DICKINSON

*Attesting Officer*

*Acting Commissioner of Patents and Trademarks*